US006648685B2

(12) United States Patent
Nankou

(10) Patent No.: US 6,648,685 B2
(45) Date of Patent: Nov. 18, 2003

(54) CONNECTOR

(75) Inventor: Yuuichi Nankou, Yokkaichi (JP)

(73) Assignee: Sumitomo Wiring Systems, Ltd., Mie (JP)

( * ) Notice: Subject to any disclaimer, the term of this patent is extended or adjusted under 35 U.S.C. 154(b) by 0 days.

(21) Appl. No.: 10/058,062

(22) Filed: Jan. 29, 2002

(65) Prior Publication Data

US 2002/0102877 A1 Aug. 1, 2002

(30) Foreign Application Priority Data

Jan. 29, 2001 (JP) ..... 2001-020241

(51) Int. Cl.[7] ..... H01R 13/40
(52) U.S. Cl. ..... 439/595
(58) Field of Search ..... 439/595, 752, 439/744

(56) References Cited

U.S. PATENT DOCUMENTS 5,324,208 A 6/1994 Kodama et al. ..... 439/271
5,944,557 A * 8/1999 Fukuda ..... 439/595
6,386,916 B1 * 5/2002 Tachi et al. ..... 439/595

FOREIGN PATENT DOCUMENTS

JP 2000-12148 * 1/2000
JP 2000-286017 * 10/2000
JP 2001-148364 * 5/2002

* cited by examiner

*Primary Examiner*—Renee Luebke
*Assistant Examiner*—Ann McCamey
(74) *Attorney, Agent, or Firm*—Banner & Witcoff, Ltd.

(57) ABSTRACT

The invention provides a front retainer used in common for both male and female electrical connectors. A female housing 30 and a male housing 40 are each provided with two large cavities 33L and 43L, these being opposite one another. In the female housing 30, the large cavity 33L on the right side is located below a central line XF, and the large cavity 33L on the left side is located above the central line XF. Bending spaces 36 of large lances 34L have recessed spaces 37 contiguous therewith either above or below. In the male housing 40, the large cavity 43L on the left side is located below a central line XM, and the large cavity 43L on the right side is located above the central line XM. Bending spaces 46 of large lances 44L have recessed spaces 47 contiguous therewith either above or below. A retainer 50 has female protruding members 55 and male protruding members 56 aligned above and below, these fitting respectively with the female bending spaces 36 and the male bending spaces 46. The up-down configuration of the retainer 50 is laterally reversed on the left and right sides.

12 Claims, 7 Drawing Sheets

CONNECTOR

TECHNICAL FIELD

The present invention relates to an electrical connector provided with a front retainer.

BACKGROUND TO THE INVENTION

A front retainer doubly retains electrical terminal fittings which have been inserted into cavities of a connector body and are retained therein by lances. One such front retainer, as described in JP 6-5326, is inserted from an anterior face (a fitting face) side of the cavities. Protruding portions of the front retainer protrude into bending spaces of lances and thereby prevent the lances from bending. Consequently, this double retaining is performed indirectly.

It is desirable to reduce the number of components in this type of retainer, and to make the retainer a common retainer, i.e., one that can be shared by both male and female connectors. However, since the terminal fittings of the male and female connectors have mutually differing shapes, the lances for each are located in differing positions. Generally, the lances on the female side are located further inwards from the fitting face than the lances on the male side. The difference in location of the lances (and, consequently, the location of the bending spaces thereof) is particularly great when the terminal fittings are large. Since the protruding portions of the retainer that are inserted into the bending spaces must consequently be of differing lengths, there are many obstacles to making a common retainer.

SUMMARY OF THE INVENTION

According to the invention, there is provided a connector assembly comprising male and female connector housings which are mutually engageable along a fitting direction, each housing having a plurality of terminal cavities aligned with the fitting direction, and each said cavity having an electrical terminal fitting housed therein, each terminal cavity being further provided with a resilient lance at one side thereof and adapted for bending and retaining a respective terminal fitting therein, and the connector assembly further including a retainer for each of said housings, the respective retainer being insertable into a retainer aperture of a respective housing to prevent bending of said lances, characterized in that said male and female housings have an even number of terminal cavities, symmetrically located, half on either side of a dividing plane extending in the fitting direction, each said retainer aperture being contiguous with bending spaces for said lances, and with accommodation spaces, each terminal cavity being associated with a bending space on one side of said plane and an accommodation space on the other side of said plane, and said retainer having male and female protrusions provided thereon for each terminal cavity, the protrusions being adapted in each case to engage one in a respective bending space and one in an accommodation space whereby the male protrusions engage lances of male terminal fittings, and female protrusions engage lances of female terminal fittings.

The invention permits the use of a common retainer for both male and female terminal fittings, correct association with the male and female lances being assured by placing the terminal cavities on either side of the dividing plane.

BRIEF DESCRIPTION OF DRAWINGS

Other features of the invention will be apparent from the following description of a preferred embodiment shown by way of example only in the accompanying drawings, in which.

The present invention has taken the above problem into consideration, and aims to present a front retainer capable of being used in common for both male and female connectors.

DESCRIPTION OF PREFERRED EMBODIMENT

An embodiment of the present invention is described below with the aid of FIGS. 1 to 13.

Figure 1:
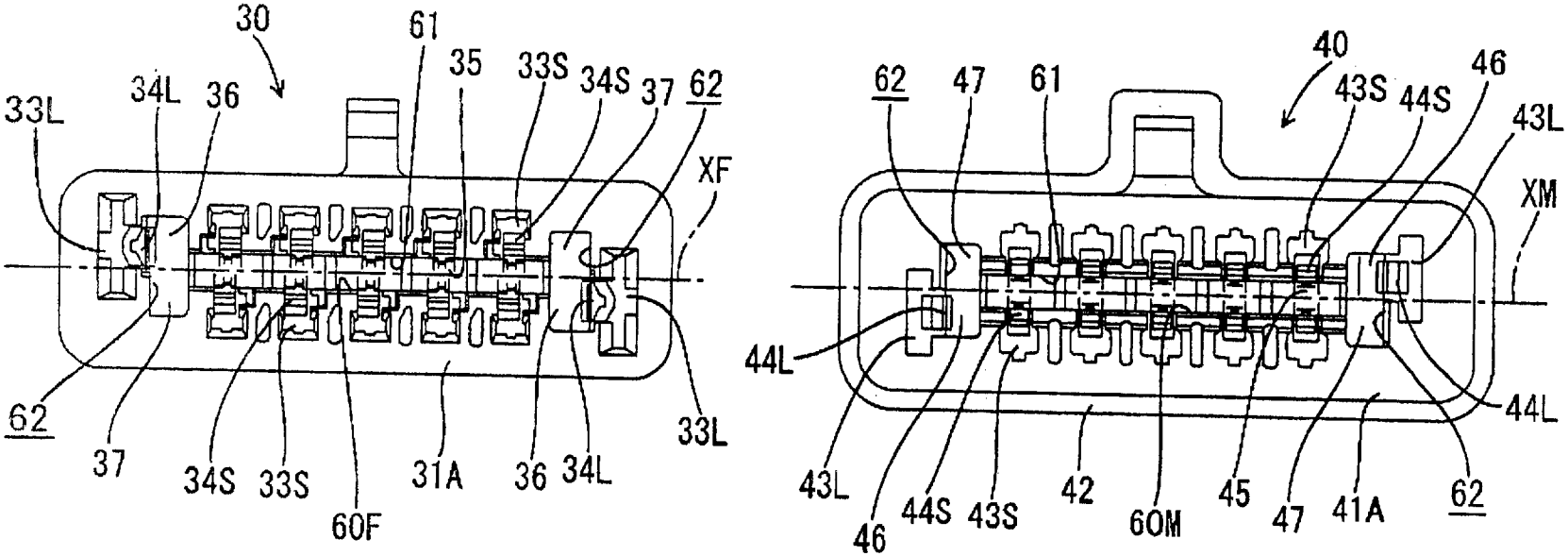
FIG. 1 is a front view of a female connector housing and a male connector housing.

In the following embodiment, a hybrid connector is described which houses a mixture of terminal fittings of differing sizes. As shown in FIG. 1, this connector is provided with a female connector housing 30, and a male connector housing 40, the two being capable of fitting mutually together.

Figure 2:
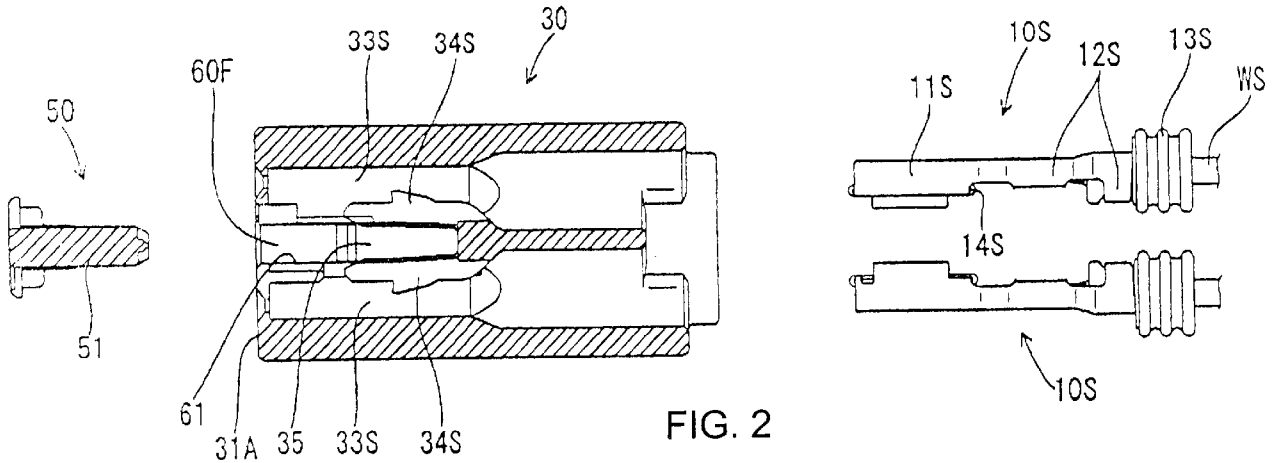
FIG. 2 is a disassembled vertical cross-sectional view of a portion of a small cavity of the female housing.

Small female terminal fittings 10S, and large female terminal fittings 10L are housed within the female housing 30. As shown in FIG. 2, each small female terminal 10S has an approximately angular-tubular shaped joining members 11S that has a contacting member housing therein. A rubber stopper 13S and an end of a thin electric wire WS are joined to the small female terminal 10S by being crimped to a barrel member 12S at a posterior end thereof. An engaging member 14S, capable of engaging with a small lance 34S (to be described) of the female housing 30, is formed at a posterior end of the joining member 11S.

Figure 4:
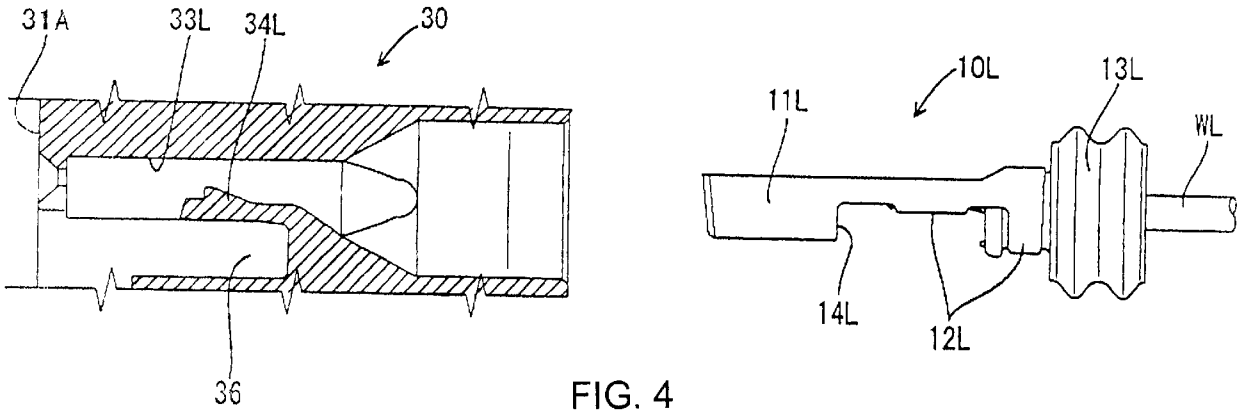
FIG. 4 is a disassembled plan cross-sectional view of a portion of a large cavity of the female housing.

As shown in FIG. 4, each large female terminal 10L is larger than the small female terminal 10S. However, like the small female terminal 10S, the large female terminal 10L is provided with a joining member 11L, and a rubber stopper 13L and an end of a thick electric wire WL are joined to the large female terminal 10L via a barrel member 12L. An engaging member 14L, capable of engaging with a large lance 34L of the female housing 30, is formed at a posterior end of the joining member 11L.

Figure 3:
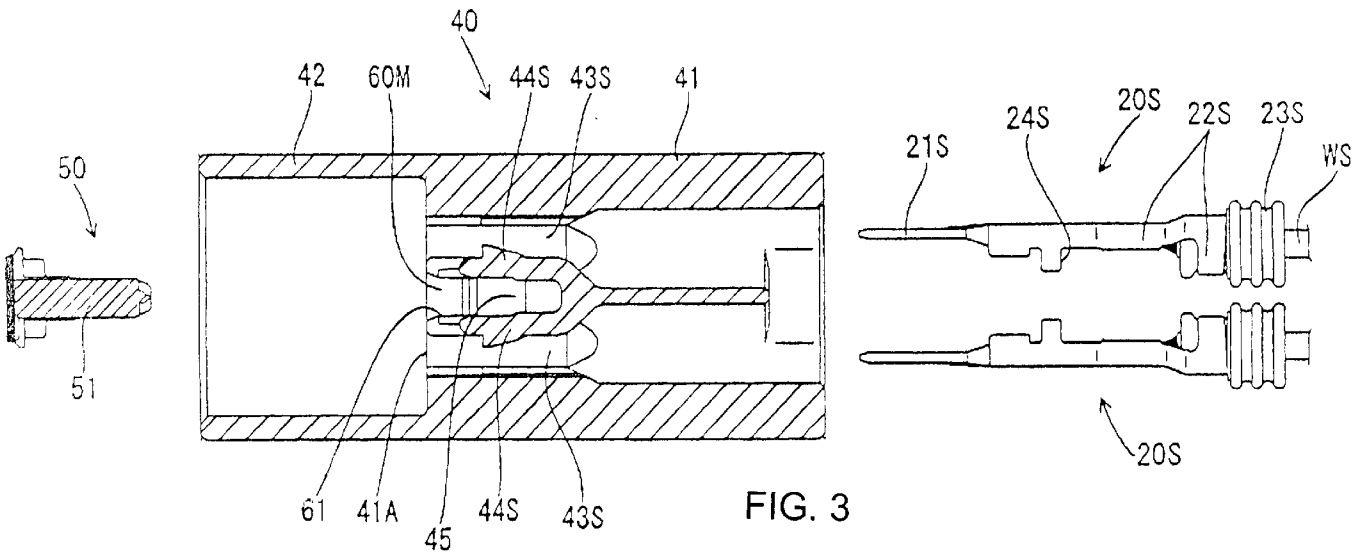
FIG. 3 is a disassembled vertical cross-sectional view of a portion of a small cavity of the male housing.

Small male terminal fittings 20S, and large male terminal fittings 20L are housed within the male housing 40. As shown in FIG. 3, each small male terminal 20S has a tab 21S formed at its anterior end, this tab 21S being inserted into the joining member 11S of the small female terminal 10S. A rubber stopper 23S and an end of a thin electric wire WS are joined to the small male terminal 20S by being crimped to a barrel member 22S at a posterior end thereof. An engaging member 24S, capable of engaging with a small lance 44S (to be described) of the male housing 40, is formed to the posterior of the tab 21S.

Figure 5:
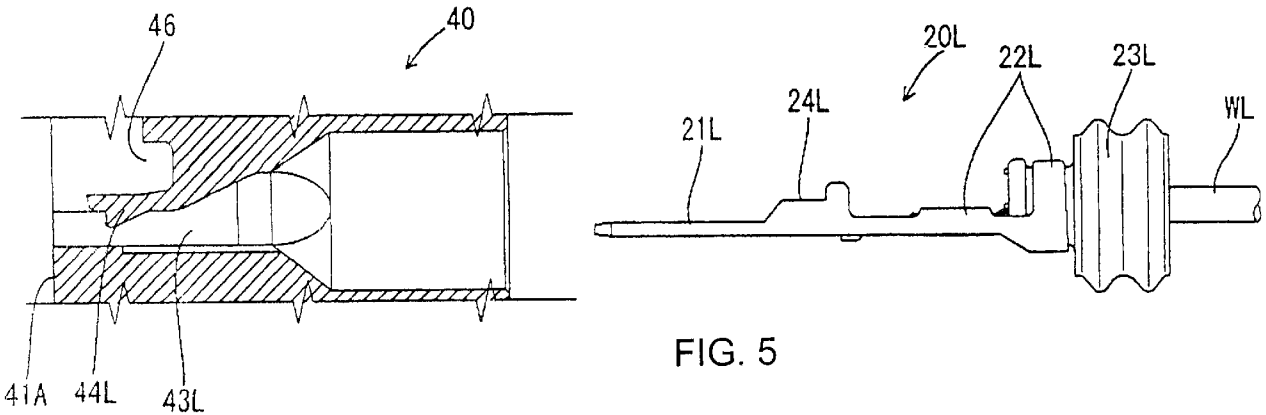
FIG. 5 is a disassembled plan cross-sectional view of a portion of a large cavity of the male housing.

As shown in FIG. 5, each large male terminal 20L is larger than the small male terminal 20S. However, like the small male terminal 20S, the large male terminal 20L is provided with a tab 21L, and a rubber stopper 23L and an end of a thick electric wire WL are joined to the large male terminal 20L via a barrel member 22L. An engaging member 24L, capable of engaging with a large lance 44L of the male housing 40, is formed to the posterior of the tab 21L.

The female housing 30 is made from plastic and, as shown in FIG. 2, has a flat block-like shape. An anterior face thereof (on the left side in FIG. 2) forms a fitting face 31A. As shown in FIG. 1, ten small cavities 33S, into which the small female terminals 10S are inserted, are formed as an upper and a lower layer within a central portion of the female housing 30. The small lances 34S, which are capable of engaging with the engaging members 14S of the small female terminals 10S, are formed symmetrically on base faces of the upper layer of small cavities 33S and on ceiling faces of the lower layer of small cavities 33S. A bending space 35, into which the small lances 34S can bend, is formed between the upper and the lower small lances 34S, serving as a common bending space for both upper and lower rows.

A pair of left and right large cavities 33L are formed to either side of the region of the female housing 30 in which the small cavities 33S are formed. The large male terminals 10L can be inserted therein. The two large cavities 33L are located symmetrically in the left-right direction. As shown in FIG. 4, the large lance 34L is formed on an inner face of each of the large cavities 33L, this large lance 34L being capable of engaging with the engaging member 14L of the large female terminal 10L. The large lance 34L is capable of bending into a bending space 36 located inwards therefrom.

The large cavity 33L located on the right (when viewed from the front) is formed at a lower side relative to a central line XF that is located along the centre (relative to the up-down direction) of the female housing 30. The large cavity 33L located on the left is formed at an upper side relative to this central line XF. The large lance 34L of the right-side large cavity 33L is located below the central line XF, and the large lance 34L of the left-side large cavity 33L is located above the central line XF. Furthermore, a recessed space 37 is formed above the bending space 36 of the right-side large lance 34L, and another recessed space 37 is formed below the bending space 36 of the left-side large lance 34L. Each of these recessed spaces 37 is contiguous with its respective bending space 36.

The male housing 40 is also made from plastic. As shown in FIG. 3, a hood 42, into which an anterior half portion of the female housing 30 can fit, is formed at an anterior face of a flat main body 41 of the male housing 40. An anterior face of the main body 41 forms a fitting face 41A. As shown in FIG. 1, ten small cavities 43S, into which the small male terminals 20S are inserted, are formed as an upper and a lower layer within a central portion of the main body 41. These small cavities 43S are symmetrical above and below. The small lances 44S, which are capable of engaging with the engaging members 24S of the small male terminals 20S, are formed symmetrically on base faces of the upper layer of small cavities 43S and on ceiling faces of the lower layer of small cavities 43S. A bending space 45, into which the small lances 44S can bend, is formed between the upper and the lower small lances 44S, serving as a common bending space for both upper and lower rows. As can be seen by comparing FIGS. 2 and 3, the small lances 44S of the male housing 40 are located less deeply inwards, relative to the fitting face 41A, than the small lances 34S of the female housing 30.

A pair of left and right large cavities 43L are formed on either side of the region of the male housing 40 in which the small cavities 43S are formed. The large male terminals 20L can be inserted therein. The two large cavities 43L are located symmetrically in the left-right direction. As shown in FIG. 5, the large lance 44L is formed on an inner face of each of the large cavities 43L, this being capable of engaging with the engaging member 24L of the large male terminal 10L. This large lance 44L is capable of bending into a bending space 46 located inwards therefrom.

The large cavity 43L located on the left (when viewed from the front) is formed at a lower side relative to a central line XM that is located along the centre (relative to the up-down direction) of the male housing 40. The large cavity 43L located on the right is formed at an upper side relative to the central line XM. The large lance 44L of the left-side large cavity 43L is located below the central line XM, and the large lance 44L of the right-side large cavity 43L is located above the central line XM. As can be seen by comparing FIGS. 4 and 5, the large lances 44L of the male housing 40 are also located less deeply inwards, relative to the fitting face 41A, than the large lances 34L of the female housing 30.

The lines XF, XM represent dividing planes extending at right angles to the fitting face of the housings.

Furthermore, a recessed space 47 is formed above the bending space 46 of the left-side large lance 44L, and another recessed space 47 is formed below the bending space 46 of the right-side large lance 44L. Each of these recessed spaces 47 is contiguous with its respective bending space 46. These recessed spaces 47 are deeper than the bending spaces 46.

In order for an identical retainer 50 to be capable of being attached to both the female connector housing 30 and the male connector housing 40, a retainer insertion hole 60F and a retainer insertion hole 60M are formed in the fitting face 31A of the female housing 30 and the fitting face 41A of the male housing 40 respectively. The front face shapes of these male and female retainer insertion holes 60M and 60F are identical. As shown in FIG. 1 the retainer insertion hole 60F of the female housing 30 is formed from: a horizontally extending hole 61 that opens into the common bending space 35 of the upper and the lower small lances 34S; and vertically extending holes 62 that are located at the left and right sides of the horizontal hole 61 and are contiguous with the bending spaces 36 of the large lances 34L and the recessed spaces 37 formed either above or below these bending spaces 36. In the same way, the retainer insertion hole 60M of the male housing 40 is formed from: a horizontal hole 61 that opens into the common bending space 45 of the upper and the lower small lances 44S; and vertical holes 62 that are located at the left and right sides of the horizontal hole 61 and are contiguous with the bending spaces 46 of the large lances 44M and the recessed spaces 47 formed either above or below these bending spaces 46.

Figure 6:
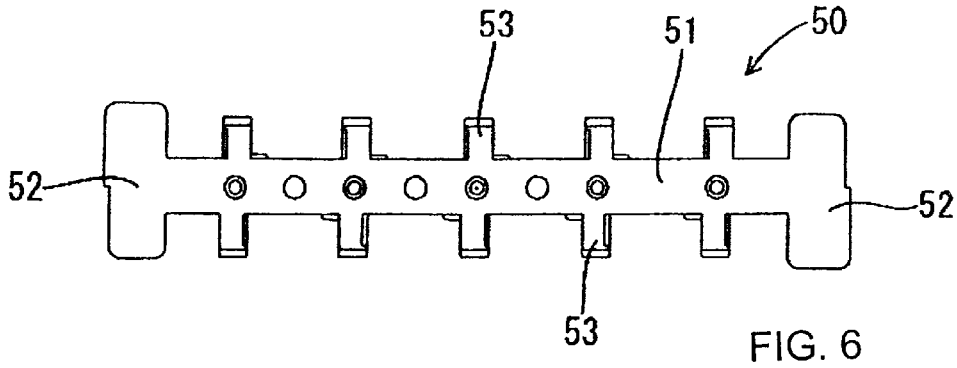
FIG. 6 is a front view of a retainer.
Figure 7:
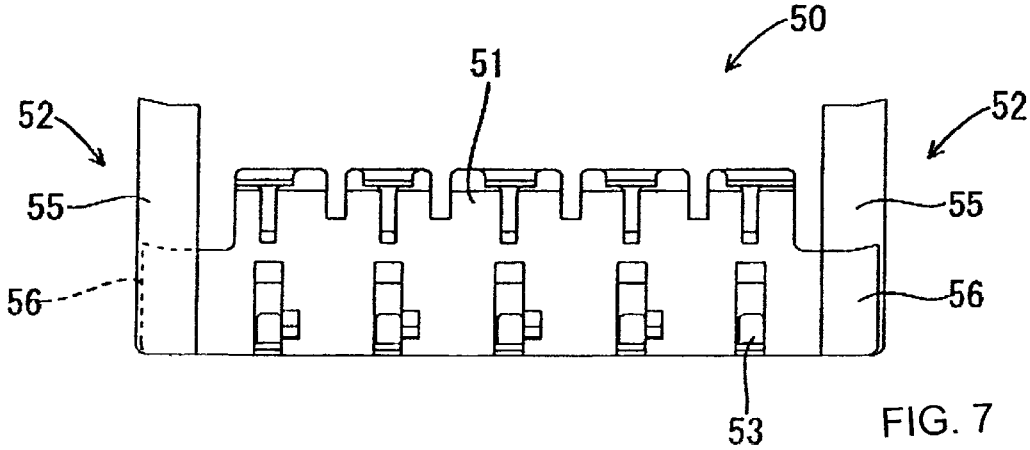
FIG. 7 is a plan view of the retainer.
Figure 8:
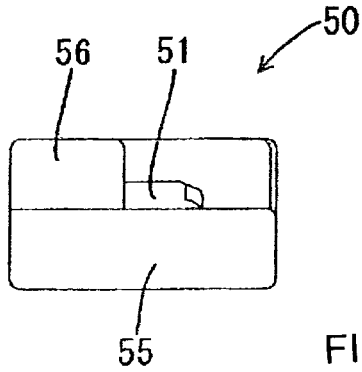
FIG. 8 is a side face view of the retainer.
Figure 10:
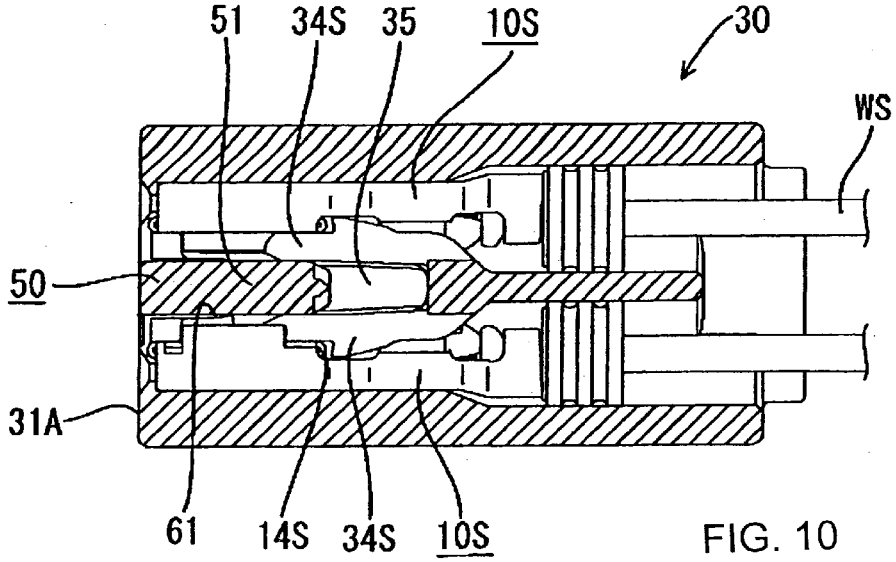
FIG. 10 is a vertical cross-sectional view of a portion of the small cavity of the female housing after the retainer has been attached.
Figure 11:
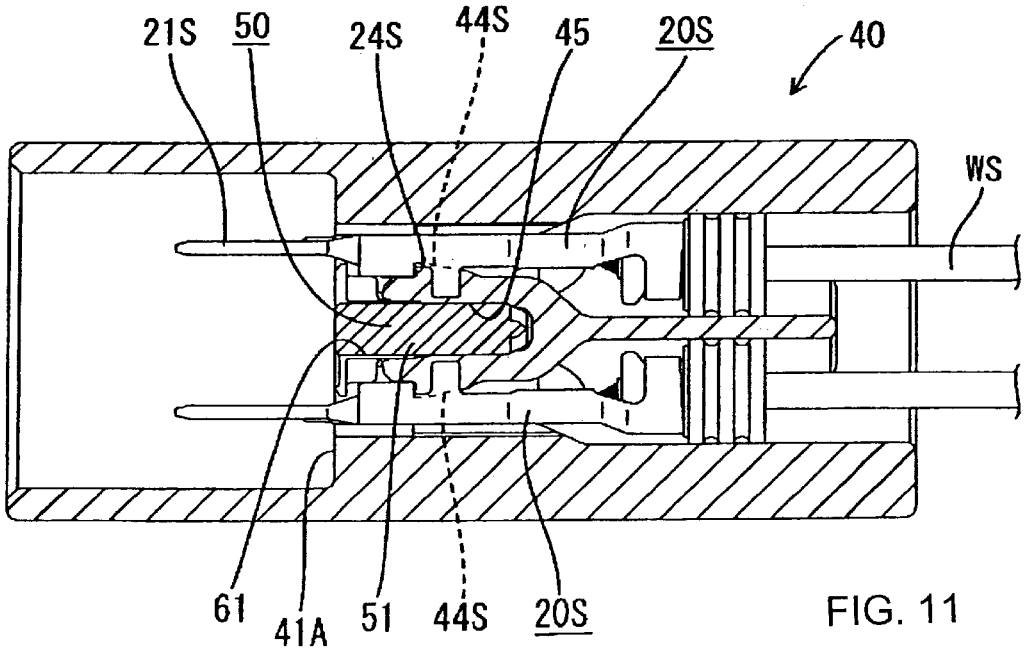
FIG. 11 is a vertical cross-sectional view of a portion of the small cavity of the male housing after the retainer has been attached.

The retainer 50 is made from plastic and has a shape allowing it to be inserted into the retainer insertion holes 60F and 60M. As shown in FIGS. 6 to 8, the retainer 50 has a horizontal protruding portion 51 that can be inserted into the horizontal hole 61 of the retainer insertion hole 60F or 60M and, at the left and right sides of this horizontal protruding portion 51, vertical protruding portions 52 that can be inserted into the vertical holes 62. As shown in FIGS. 10 and 11, the horizontal protruding portion 51 can be inserted into an outermost side of the common bending space 35 (provided for the small lances 34S) of the female housing 30, and its size in its direction of insertion is such that it can be inserted as far as an innermost end of the bending space 45 (provided for the small lances 44S) of the male housing 40.

Furthermore, protecting walls 53 protrude from upper and lower faces of an edge portion of the outermost side of the protruding portion 51. These protecting walls 53 cover openings at the outermost side of the male and female small lances 44S and 34S.

Each vertical protruding portion 52 is provided with a female protruding member 55 and a male protruding member 56. Each female protruding member 55 is large in size in its direction of insertion, such that it reaches an innermost end of the bending space 35 of each of the female large lances 34L. Each male protruding member 56 is small in size in its direction of insertion, such that it reaches an innermost end of the bending space 46 of each of the male large lances 44L. These female protruding members 55 and male protruding members 56 mutually overlap in the up-down direction, and the up-down relationship thereof is reversed on the left and right sides. That is, when viewed from the front, on the right side the shorter male protruding member 56 is located on the upper side and the longer female protruding member 55 is located on the lower side. The left side has the opposite relative positioning of the male protruding member 56 and the female protruding member 55.

Next, the operation of the present embodiment is described. First, the male and female terminal fittings are housed within the male and female connector housings 40 and 30. As shown in FIG. 2, the small female terminals 10S are aligned so as to face upwards or downwards, and are inserted, in turn, from the posterior into the corresponding small cavities 33S of the female housing 30. As the small female terminals 10S are pushed in, they cause the small lances 34S to bend into the bending space 35. When the small female terminals 10S have been pushed in to a correct position, the small lances 34S return to their original position, thereby engaging with the engaging members 14S of the small female terminals 10S (see FIG. 10). Further, as shown in FIG. 4, the large female terminals 10L are aligned so as to face to the left or right, and are inserted from the posterior into the corresponding large cavities 33L. As the large female terminals 10L are pushed in, they cause the large lances 34L to bend into the bending spaces 36. When the large female terminals 10L have been pushed in to a correct position, the large lances 34L return to their original position, thereby engaging with the engaging members 14L of the large female terminals 10L (see FIG. 12).

As shown in FIG. 3, the small male terminals 20S are aligned so as to face upwards or downwards, and are inserted, in turn, from the posterior into the corresponding small cavities 43S of the male housing 40. As the small male terminals 20S are pushed in, they cause the small lances 44S to bend into the bending space 45. When the small male terminals 20S have been pushed in to a correct position, whereby the tabs 21S protrude into the hood 42 the small lances 44S return to their original position, thereby engaging with the engaging members 24S of the small male terminals 20S (see FIG. 11). Further, as shown in FIG. 5, the large male terminals 20L are aligned so as to face to the left or right, and are inserted from the posterior into the corresponding large cavities 43L. As the large male terminals 20L are pushed in, they cause the large lances 44L to bend into the bending spaces 46. When the large male terminals 20L have been pushed in to a correct position, whereby the tabs 21L protrude into the hood 42, the large lances 44L return to their original position, thereby engaging with the engaging members 24L of the large male terminals 20L (see FIG. 13).

Figure 9:
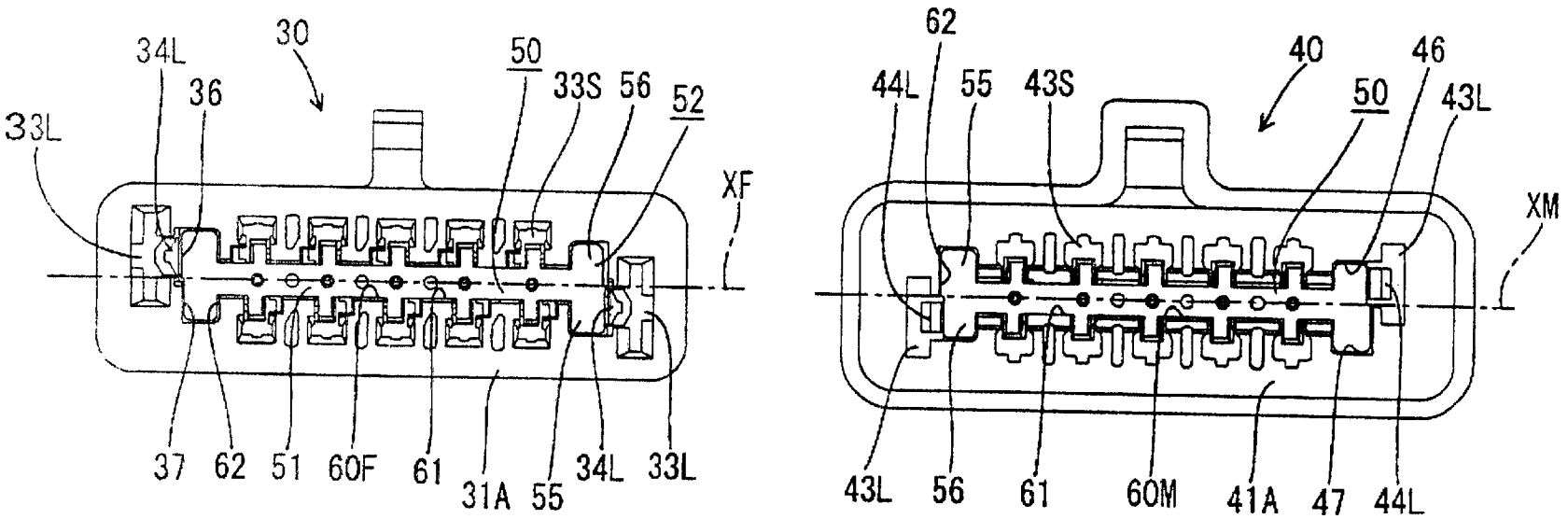
FIG. 9 is a front view of the male and female connector housings having the retainer attached thereto.

Next, as shown in FIG. 9, the retainer 50 is attached to the female or male connector housing 30 or 40. When the retainer 50 is inserted into the retainer insertion hole 60F of the female housing 30 (see FIG. 10), the tip of the horizontal protruding portion 51 is inserted, via the horizontal hole 61, so as to protrude into the outermost side of the bending space 35. This prevents the small lances 34S from bending, thereby doubly retaining the small female terminals 10S.

Figure 12:
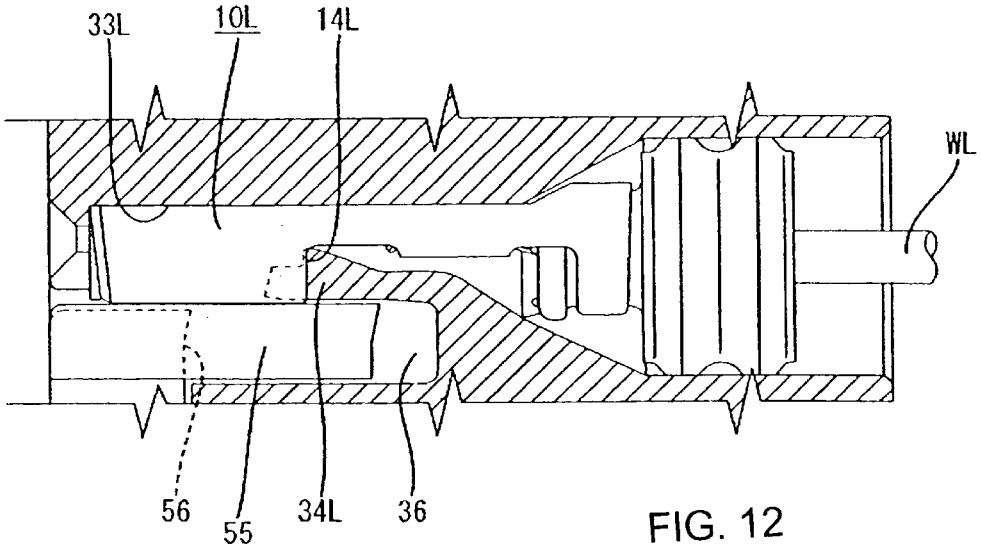
FIG. 12 is a plan cross-sectional view of a portion of the large cavity of the female housing after the retainer has been attached.

The vertical protruding portions 52 enter the vertical holes 62 and, as shown in FIG. 12, the male protruding members 56 thereof enter the recessed spaces 37 while the female protruding members 55 protrude into the bending spaces 35 of the large lances 34L. This prevents the large lances 34L from bending, thereby doubly retaining the large female terminals 10L as well.

When the retainer 50 is inserted into the retainer insertion hole 60M of the male housing 40 (see FIG. 11), the tip of the horizontal protruding portion 51 is inserted, via the horizontal hole 61, so as to protrude as far as the outermost end of the bending space 45. This prevents the small lances 44S from bending, thereby doubly retaining the small male terminals 20S.

Figure 13:
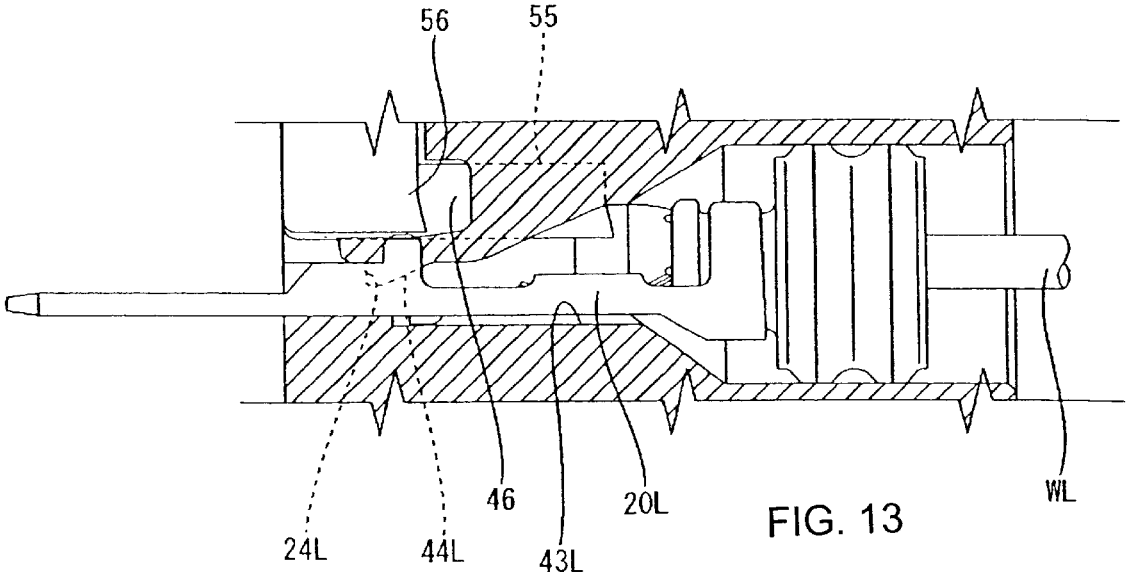
FIG. 13 is a plan cross-sectional view of a portion of the large cavity of the male housing after the retainer has been attached.

The vertical protruding portions 52 enter the vertical holes 62 and, as shown in FIG. 13, the female protruding members 55 thereof enter the recessed spaces 47 while the male protruding members 56 protrude into the bending spaces 46 of the large lances 44L. This prevents the large lances 44L from bending, thereby doubly retaining the large male terminals 20L as well.

From this state, the male and female connector housings 40 and 30 are fitted together, the small female terminals 10S and the small male terminals 20S making contact, and the large female terminals 10L and the large male terminals 20L making contact.

In the embodiment described above, the male and female connector housings 40 and 30 are each provided with two large cavities 43L and 33L, these being displaced above and below (relative to the central line XM or XF), and being laterally reversed with respect to one another. The bending spaces 46 and 36 of the male large lances 44L and the female large lances 34L are also displaced above and below and laterally reversed relative to one another. The male protruding members 56 and female protruding members 55 of the retainer 50 are aligned above and below in a manner whereby they fit with the male bending spaces 46 and the female bending spaces 36 respectively of the male lances 44L and the female large lances 34L. Consequently, the retainer 50 can be used as a common retainer for both the male and the female connector housings 40 and 30.

In this manner, the number of components can be reduced, and production costs can thereby be lowered.

The present invention is not limited to the embodiments described above. For example, the possibilities described below also lie within the technical range of the present invention. In addition, the present invention may be embodied in various other ways without deviating from the scope thereof.

(1) The present invention is not limited to the hybrid connector described in the above embodiment. It is equally suited for a conventional connector wherein only one type of terminal fitting is inserted into a connector housing.

(2) The number of cavities for which the retainer acts as a common retainer is not limited to two. Any even number of cavities is equally suitable, as long as half of those cavities are laterally reversed, with respect to the central line, from the other half.

What is claimed is:

1. A connector assembly comprising male and female connector housings which are mutually engageable along a fitting direction, each housing having a retainer aperture and a plurality of terminal cavities aligned with the fitting direction, and each said cavity having an electrical terminal fitting housed therein, each terminal cavity being further provided with a resilient lance at one side thereof adapted for bending into a respective bending space and retaining a respective terminal fitting therein, and the connector assembly further including a retainer for each of said housings, wherein the retainers all have the same construction, one of the retainers being insertable into the retainer aperture of each said housing to prevent bending of said lances, wherein said terminal cavities are located on both sides of a dividing plane extending in the fitting direction, each terminal cavity being associated with a bending space on one side of said plane, and said retainer being fitted into the retainer aperture in each housing along the dividing plane and setting in each said bending space to doubly lock each lance.

2. An assembly according to claim 1 wherein said bending spaces and accommodation spaces are provided in pairs arranged substantially at right angles to said dividing plane.

3. An assembly according to claim 1 wherein said lances are wholly on one or other side of said plane.

4. An assembly according to claim 1 wherein said retainer apertures are contiguous with respective bending spaces.

5. An assembly according to claim 1 wherein said bending spaces are contiguous with said accommodation spaces.

6. An assembly according to claim 1 in which said retainer has male and female protrusions provided thereon for each terminal cavity, wherein the protrusions are adapted in each case to engage one in a respective bending space and one in an accommodation space whereby the male protrusions engage lances for the male terminal fittings, and female protrusions engage the lances for the female terminal fittings.

7. An assembly according to claim 1 wherein said female protrusion projects to a greater extent than said male protrusion.

8. An assembly according to claim 7 wherein said bending spaces and accommodation spaces are provided in pairs arranged substantially at right angles to said dividing plane.

9. An assembly according to claim 1 wherein said male and female housings have an even number of terminal cavities.

10. An assembly according to claim 9 wherein said cavities are symmetrically located, half on either side of said dividing plane.

11. An assembly according to claim 1 wherein said retainer apertures are contiguous with respective accommodation spaces.

12. An assembly according to claim 11 wherein respective accommodation spaces are on the opposite side of said plane to bending spaces associated therewith.

* * * * *